US007640959B2

(12) United States Patent
Gambini

(10) Patent No.: US 7,640,959 B2
(45) Date of Patent: Jan. 5, 2010

(54) DEVICE FOR GLUING THE END FLAP OF A LOG, AND CORRESPONDING GLUING METHOD

(75) Inventor: Giovanni Gambini, Pisa (IT)

(73) Assignee: Gambini International S.A., Luxembourg (LU)

( * ) Notice: Subject to any disclaimer, the term of this patent is extended or adjusted under 35 U.S.C. 154(b) by 787 days.

(21) Appl. No.: 11/157,342

(22) Filed: Jun. 21, 2005

(65) Prior Publication Data

US 2005/0284557 A1 Dec. 29, 2005

(30) Foreign Application Priority Data

Jun. 24, 2004 (IT) ..... MI2004A1274

(51) Int. Cl.
*B32B 37/10* (2006.01)

(52) U.S. Cl. ..... 156/356; 156/357; 156/446; 156/450; 156/455; 156/456

(58) Field of Classification Search ..... 156/64, 156/187, 191, 356, 357, 361, 446, 448, 449, 156/450, 455, 456, 578
See application file for complete search history.

(56) References Cited

U.S. PATENT DOCUMENTS 5,242,525 A 9/1993 Biagiotti
5,643,398 A 7/1997 Lumberg
5,681,421 A 10/1997 Biagiotti (Continued)

FOREIGN PATENT DOCUMENTS

GB 1495445 A 12/1977

(Continued)

OTHER PUBLICATIONS

European Search Report, Jul. 27, 2007.

*Primary Examiner*—George R Koch, III
(74) *Attorney, Agent, or Firm*—James V. Costigan; Hedman & Costigan P.C.

(57) ABSTRACT

An improved device for gluing the end flap of a log and a gluing method which can be implemented in a machine for producing logs, in which the logs (14), which come from a re-reeling machine, are fed to a gluing device (11) comprising in succession a bottom unwinding roller (16) and a top feed belt (17), and, immediately downstream of the unwinding roller (16), at least one stretch of inclined surface (21), of a pre-set length, followed by a vacuum-suction roller (24), set on top of which is a top roller (25), and then by a glue dispenser (27), there being provided on top of the unwinding roller (16) a blower element (19) for blowing an end flap (29) of the log (14) and, underneath, a photo-electric cell (20) for detecting the end flap (29), in which the log fed to the unwinding roller (16) is set with a position of the free end staggered by an angle (α), which is a function of the diameter of the log and of the pre-set length of the stretch of inclined surface (21), in such a way that, when the log thus positioned rolls on the inclined surface, it sets itself on the suction roller (24), with the free portion of the end flap (29) set exactly corresponding to the area of contact with the suction roller (24).

3 Claims, 3 Drawing Sheets

U.S. PATENT DOCUMENTS

| | | | | |
|---|---|---|---|---|
| 6,682,623 | B1 | 1/2004 | Biagiotti | |
| 7,089,981 | B2 * | 8/2006 | Gambini | 156/357 |
| 2002/0040676 | A1 | 4/2002 | Gambini | |
| 2002/0170649 | A1 * | 11/2002 | Butterworth et al. | 156/64 |
| 2004/0144495 | A1 | 7/2004 | Gambini | |

FOREIGN PATENT DOCUMENTS

| | | | |
|---|---|---|---|
| JP | 08 119502 | A | 5/1996 |

* cited by examiner

DEVICE FOR GLUING THE END FLAP OF A LOG, AND CORRESPONDING GLUING METHOD

The present invention relates to an improved gluing device for gluing the end flap of a log of paper and to the gluing method that can be implemented in a machine for producing logs.

Known to the art are complex apparatuses and methods that enable production of lengthy rolls, referred to normally as "logs", of paper suitable for household use, such as rolls of toilet paper, rolls of kitchen wipes and the like. In these known apparatuses, once winding of the paper has been carried out, it is necessary to spread glue in various ways to obtain a stable bonding of the end flap of the paper of each individual log. In fact, a certain amount of glue fixes the end flap to the remaining part of the log, before this is cut into a number of smaller rolls.

For the above purpose, the glue is spread wherever necessary and desired, in various ways, such as by spraying, with passage of the flap or of the roll over a slit, from which a dosed amount of glue is dispensed by overflowing, the paper picking up the glue from an element containing glue, etc., once the end flap has been unwound for a portion thereof from the rest of the log.

The above known devices for gluing the end flap, albeit functioning in a more than satisfactory way, might, on the other hand, not enable uniform dispensing and spreading of the glue, in a dosed amount and exactly in the desired position, with a possible consequent excessive consumption of glue and with dispensing of glue on a larger stretch of paper, which would hence no longer be usable.

In addition to the aforesaid problems, it should be taken into account that the devices for gluing the end flap of a log are particularly complicated both from the constructional standpoint and from the standpoint of the action performed between the various parts that cause the log to advance and the end flap to unwind, at least for a portion thereof and that apply the glue.

A main purpose of the present invention is thus to identify a solution to the technical problems mentioned above both regarding correct dispensing or application of the glue and correct and sufficient unwinding of the end flap in a device for gluing the end flap of the log.

Another purpose of the present invention is to provide a gluing device that is as simple as possible both as regards its structure and as regards its operation, and that can in any case guarantee a satisfactory productivity.

The above purposes according to the present invention are achieved by providing an improved gluing device for gluing the end flap of a log and a corresponding gluing method that can be implemented in a machine for producing logs, as set forth in the independent claims.

Further outstanding and particular characteristics of the present invention form the subject of the dependent claims.

The characteristics and advantages of an improved gluing device for gluing the end flap of a log and of a corresponding gluing method that can be implemented in a machine for producing logs according to the present invention will emerge more clearly evident from the ensuing description, which is provided purely by way of non-limiting example of an embodiment thereof, with reference to the annexed plate of drawings, in which.

Figure 1:
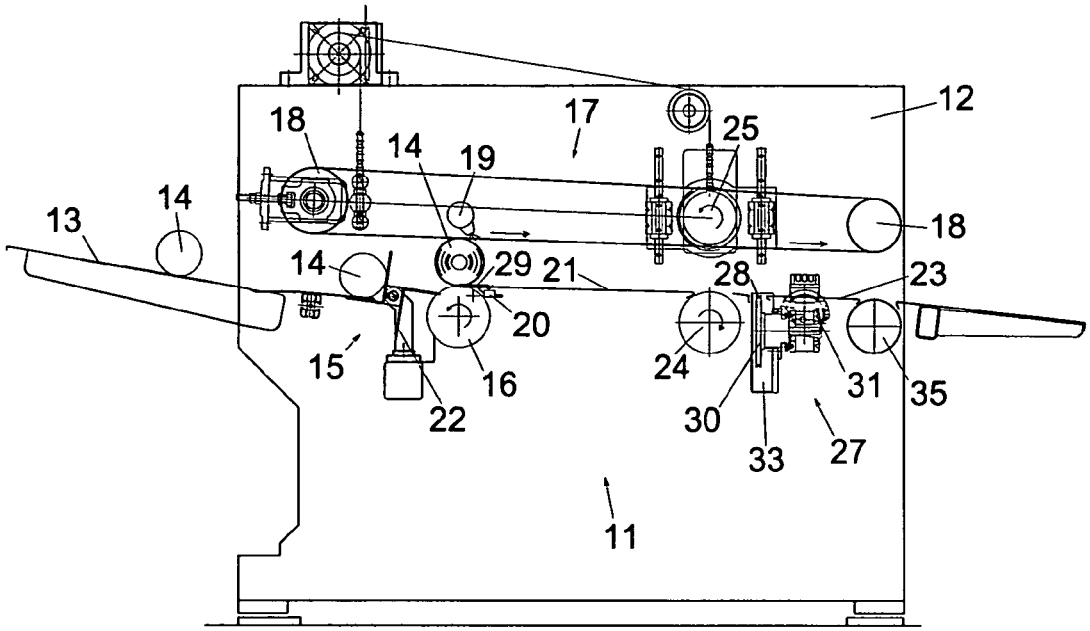
FIG. 1 is a partially sectioned side elevation view of a gluing device according to a first embodiment of the present invention in a first operating position, in which the log is blocked between an unwinding roller and a feed belt.

With reference to the figures, illustrated therein is a gluing device for gluing the end flap of a log, designated as a whole by 11, set in a machine for the formation of logs. On one side of the load-bearing structure 12 of the machine there is provided an inclined surface 13 for supply of logs 14, one after another, said logs coming from a preceding re-reeling machine (not illustrated) set upstream.

A rotary selector 15, which is of the star type and is provided with a series of pockets 22, is located at the end of the inclined supply surface 13 and receives the individual logs 14 for feeding them one after another towards the subsequent gluing device 11 proper.

According to the invention, said gluing device 11 comprises an unwinding roller 16, which is independently motor-driven and is set underneath a feed belt 17, made up of one or more stretches, which is located above and extends to form a loop between end pulleys 18.

Set immediately downstream of the unwinding roller 16 is, at the top, an air nozzle 19 and, at the bottom, a sensor 20, such as a photoelectric cell. Then, set at the output of the unwinding roller 16 is a first inclined surface 21, which ends before a first suction roller 24, which is also independently motor-driven. The suction roller 24 is connected to a vacuum source (not illustrated) and for this purpose is provided throughout its outer lateral surface with suction holes.

The suction roller 24 sets itself aligned underneath the top roller 25, which is also independently motor-driven and can be displaced vertically so that it can move up to and away from the suction roller 24. The top roller 25 is set precisely in an intermediate area of the feed belt 17, which can thus be made up of two successive portions.

Underneath the final part of the feed belt 17, immediately after the suction roller 24, there may be set any device for applying glue, designated as a whole by 27. In the example, this device for applying glue 27 comprises a wire 28, which is set in a direction transverse to the direction of advance of an end flap 29, which extends from the log 14 of paper. The wire 28, which in the example is of the closed-loop type, is run over end pulleys 30 (in the example illustrated two end pulleys), just one of which is shown and at least one of which is driven in continuous rotation by a motor reducer 31. The pulleys 30 are supported, so that they can rotate, on walls of a reservoir or tank 33, which contains a glue.

Finally, an inclined surface 23 for removal of the logs is provided with a further possible unloading roller 35, on top of which there in any case extends the feed belt 17, which also brings about bonding with glue between the end flap 29 of the log 14 and the log itself.

Operation of a device for gluing the end flap of a log of material 11 set in a machine for the production of finished logs is described in what follows.

The logs 14, practically wound to their final size, coming from a re-reeling machine set upstream in the production line, are fed onto the inclined surface 13.

Each individual log 14 sets itself in a pocket 22 of the rotary selector 15 and is hence fed according to a pre-set succession towards the gluing device 11 of the invention.

The log 14 sets itself on the unwinding roller 16, set at the bottom, withheld by the feed belt 17, set at the top. The unwinding roller 16 rotates in a counterclockwise direction, whereas the feed belt 17 advances in the direction indicated by the arrow 26 so as to exert a certain pressure on the log 14, albeit enabling its rotation. In this way, the end flap 29 of the log 14 is brought, by the rotation of the log 14, into a position corresponding to the blower element 19. This blower element 19 acts in such a way as to open the log by separating the end flap away from the rest of the log 14, and the photoelectric cell 20, as illustrated in FIG. 1, detecting whether this opening has occurred to a sufficient and correct extent.

In this way, the presence of the log on the unwinding roller is detected, and there is furthermore a pre-set and reliable positioning of the end flap 29.

Figure 2:
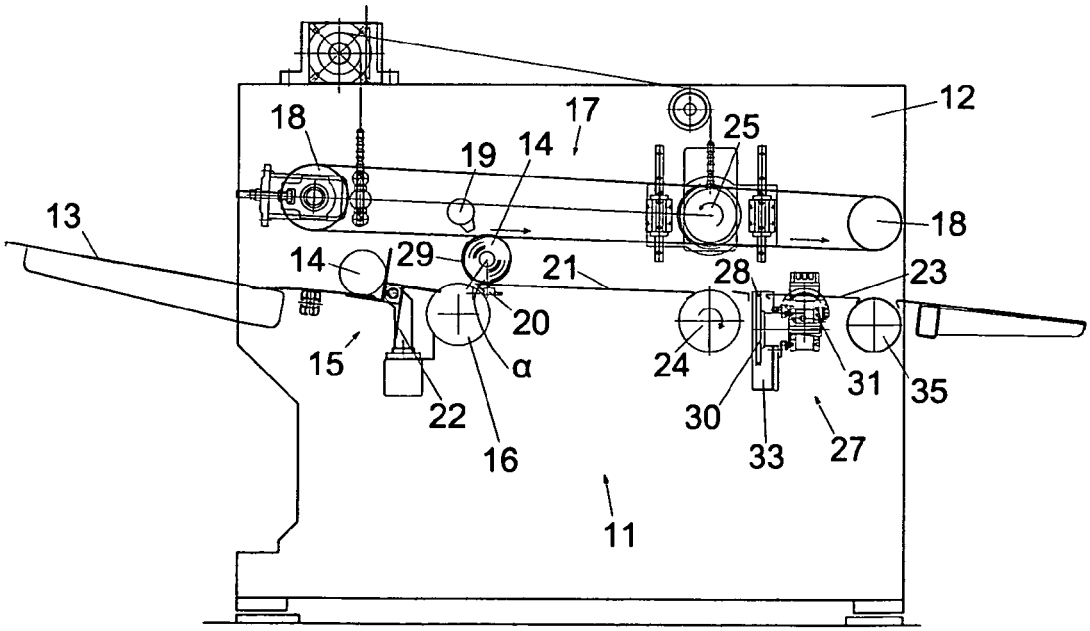
FIGS. 2 to 5 are views similar to that of FIG. 1 in subsequent steps, with the logs being fed along the path so that they are positioned correctly and pick up the glue.

In this position, the log 14 is made to roll again about its own axis for a given pre-set angle α. Consequently, at the end of rotation, the log 14 sets itself in a position such that the end flap 29 is in a position pre-selected as a function of the diameter of the log, as illustrated in FIG. 2.

Once this position of the end flap 29 of the log 14, or else of its end, calculated previously as a function of the diameter of the log being treated has been identified, the unwinding roller 16 stops. Arrest of the unwinding roller 16 and the continued forward movement of the top feed belt 17 cause the log 14 to roll on the inclined surface 21, advancing towards the suction roller 24.

Figure 3:
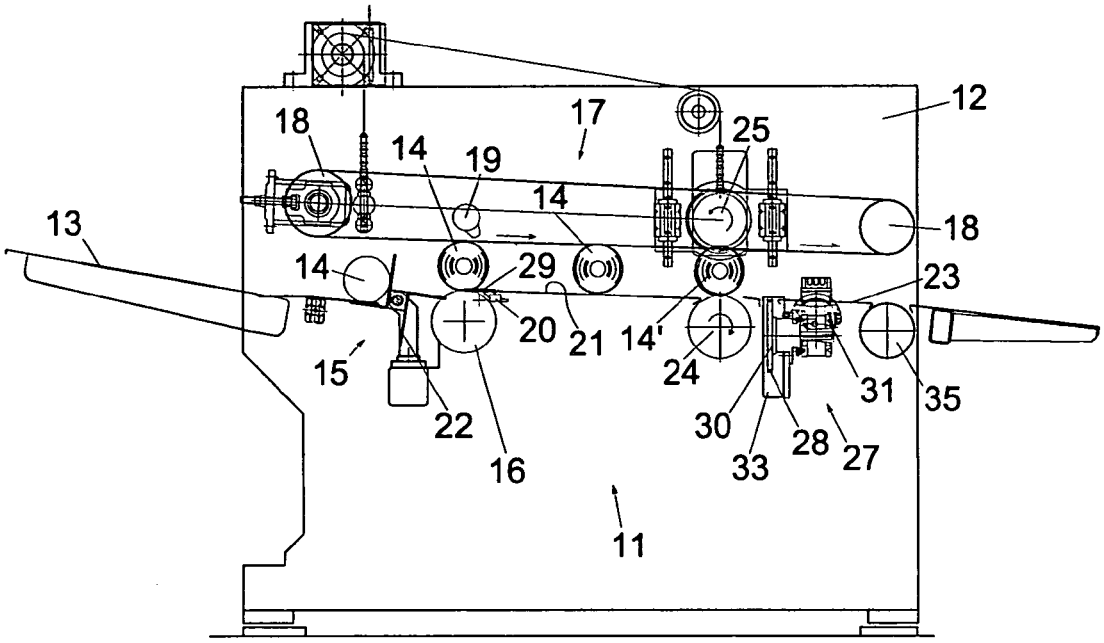

Thanks to said rolling along the inclined surface 21, which has a fixed pre-selected length, the log 14' arrives with the free end of the end flap 29 set precisely so that it corresponds to the area of contact with the suction roller 24 (which can be indicated also as the "six o'clock" position in FIG. 3).

More precisely, the log, designated as 14' in FIG. 3, comes precisely to set itself between the top roller 25 and the suction roller 24.

Figure 4:
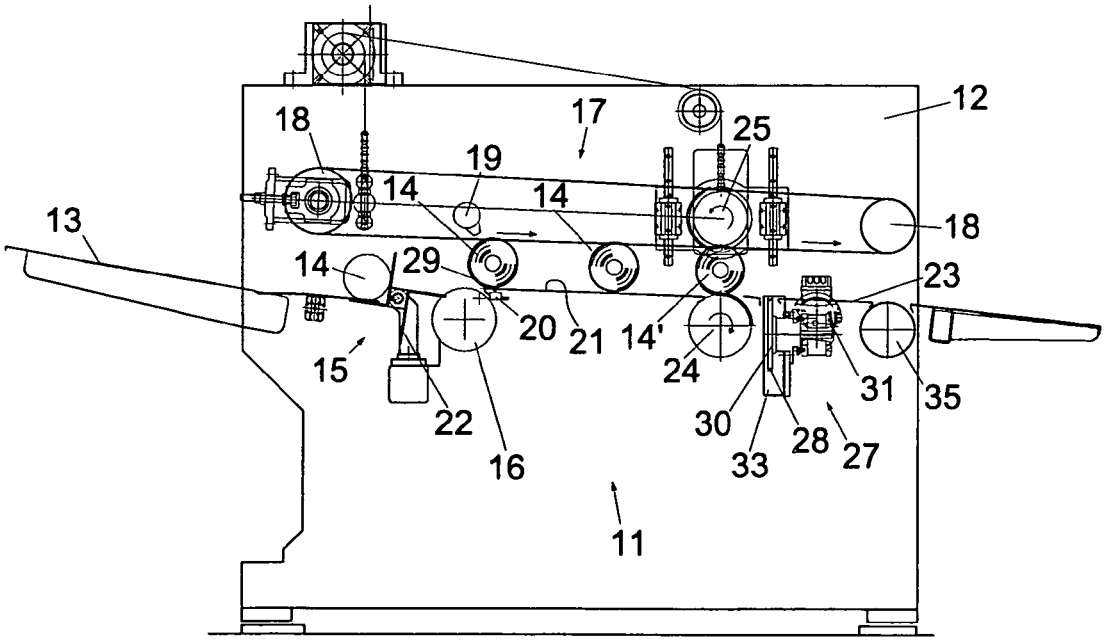

At this point, the suction roller 24 is driven in rotation in a clockwise direction, and also the top roller 25 is driven in rotation in a clockwise direction. Consequently, the end flap 29 is unwound by the pre-selected amount, as illustrated in FIG. 4.

Figure 5:
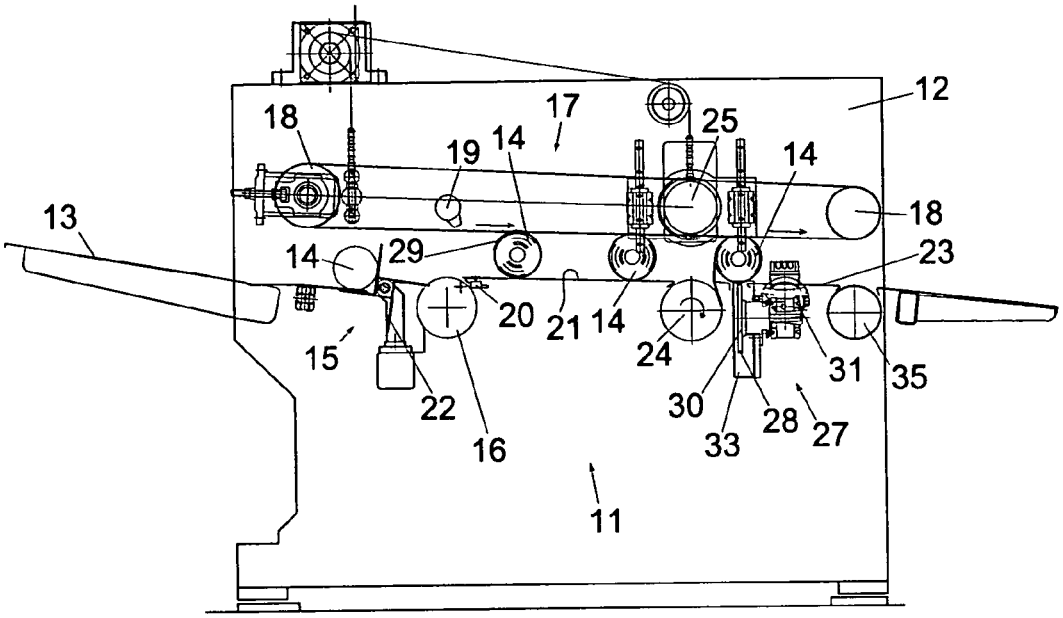
Figure 6:
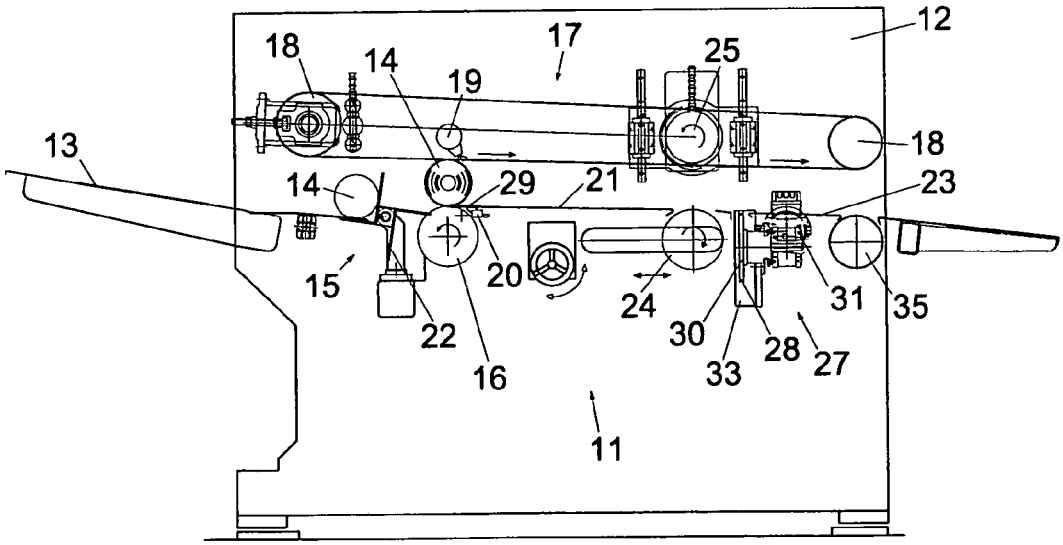
FIG. 6 is a schematic side elevation view of a gluing device in a second embodiment of the present invention.

Once this operation has been completed, arrest of the top roller 25 brings about advance of the log 14', whereas the end flap 29 is withheld by the suction roller 24. In this way, as may be seen in FIG. 5, the top belt 17 draws the log 14' to roll on the wire 28 so that it picks up the glue present thereon.

Once the log has picked up the glue, the end flap 29 is released by the suction roller 24, and the top belt 17 causes rolling of the log 14' on the inclined surface 23 for removal of the finished logs. In this way the glue remains inside the log or between the log itself and the end flap 29, locking them one against the other.

A roller 35, set on the inclined surface 23 for removal of the finished logs, by rotating, causes the glued part to be transferred into the top portion of the log, preventing the surface itself from getting soiled.

In this way, with an extremely simple gluing device, it is possible to carry out gluing of the end flap as desired.

The rotation which is varied, as likewise the different final position the log has assumed on the unwinding roller 16, enables the log itself, whatever its diameter, to arrive then above the suction roller 24 in the correct position. In fact, in this way, the log arrives in the aforesaid position always in the position with the final portion of the end flap 29 set so that it corresponds exactly to the area of contact with the suction roller 24 ("six o'clock position").

There is thus obtained a correct application of the glue on a log in order to glue thereto an end flap of the log itself in a fast and precise way. This application of glue occurs in fast succession with a number of logs in simultaneous treatment, as is also visible in the figures.

In this way, the problems indicated in the introductory part regarding the gluing devices so far known and used in the sector of logs for forming rolls of toilet paper, paper for household use and the like, have been solved.

The gluing device of the present invention thus conceived may undergo numerous modifications and variations, all of which fall within the scope of the invention itself. Furthermore, in practice, the materials used, as well as the dimensions and components, may be any whatsoever according to the technical requirements.

In a possible embodiment equivalent to the one described above, which implements the inventive concept underlying the present invention, it is possible to envisage that the position of the suction roller 24 and that of the overlying roller 25 can be displaced with respect to the position of the unwinding roller 16.

In this way, their operation can be adapted to the variation in the diameter of the log.

It is evident that it is necessary to intervene also by varying the length of the stretch of inclined surface 21 according to the requirement and as a function of the diameter of the log being treated.

This possible arrangement would also constitute a gluing device for gluing the end flap of a log according to the present invention.

The invention claimed is:

1. An improved device (11) for gluing the end flap of a log in a machine for producing logs, in which the logs (14), which come from a re-reeling machine, are fed to a gluing device (11), said gluing device (11) being characterized in that it comprises in succession:

(a) a bottom unwinding roller (16) and (b) a top feed belt (17), and, immediately downstream of the bottom unwinding roller (16), (c) a stretch of inclined surface (21), of a pre-set length, that is immediately followed by a vacuum-suction roller (24), set on top of which is (d) a top roller (25), and followed by a glue dispenser (27), (e) and having on top of the unwinding roller (16) a blower element (19) for blowing an end flap (29) of the log (14) and, (f) having underneath said log (14) when said log (14) is positioned underneath said blower element (19), a photo-electric cell (20) for detecting the end flap (29), in which the log fed to the unwinding roller (16) is set with a position of the free end staggered by an angle (.alpha.), which is a function of the diameter of the log and of the pre-set length of the stretch of inclined surface (21), in such a way that, when the log thus positioned rolls on the inclined surface (21), it sets itself on the suction roller (24) with the free portion of the end flap (29) set exactly corresponding to the area of contact with the suction roller (24).

2. The gluing device according to claim 1, characterized in that said suction roller (24) and said top roller (25) can be displaced with respect to said stretch of inclined surface (21) as a function of the diameter of said log (14).

3. The gluing device according to claim 1, characterized in that provided downstream of said glue dispenser (27) is an inclined surface (23) for removal of the finished logs, with a further possible unloading roller (35), on top of which said feed belt (17) in any case extends.

* * * * *